US005512153A

United States Patent [19]

Day et al.

[11] Patent Number: 5,512,153

[45] Date of Patent: Apr. 30, 1996

[54] CORROSION PROTECTION SYSTEM

[75] Inventors: Stephen Day, Ashton Keynes; Frank J. Lowe, Grange Park, both of United Kingdom; Christian Pierre, Brussels, Belgium

[73] Assignee: Raychem Ltd., London, United Kingdom

[21] Appl. No.: 193,171

[22] PCT Filed: Jul. 24, 1992

[86] PCT No.: PCT/GB92/01374

§ 371 Date: Jan. 20, 1994

§ 102(e) Date: Jan. 20, 1994

[87] PCT Pub. No.: WO93/02311

PCT Pub. Date: Feb. 4, 1993

[30] Foreign Application Priority Data

Jul. 25, 1991 [GB] United Kingdom ..... 9116114

[51] Int. Cl.[6] ..... C23F 13/00

[52] U.S. Cl. ..... 204/196; 204/282; 204/291; 204/294

[58] Field of Search ..... 204/147, 148, 204/196, 197, 282

[56] References Cited

U.S. PATENT DOCUMENTS

| | | | |
|---|---|---|---|
| 2,525,665 | 10/1950 | Glesner et al. | 204/197 |
| 3,012,958 | 12/1961 | Vixler | 204/197 |
| 3,022,242 | 2/1962 | Anderson | 204/196 |
| 3,623,968 | 11/1971 | Bohne | 204/197 |
| 3,629,091 | 12/1971 | George | 204/197 |
| 3,725,669 | 4/1973 | Tatum | 204/196 |
| 4,133,737 | 1/1979 | Trimble | 204/197 |
| 4,487,676 | 12/1984 | Parker et al. | 204/286 |
| 4,502,929 | 3/1985 | Stewart et al. | 204/147 |
| 4,957,612 | 9/1990 | Stewart et al. | 204/196 |
| 4,966,675 | 10/1990 | Steininger | 204/290 R |

FOREIGN PATENT DOCUMENTS

| | | |
|---|---|---|
| 0067679 | 12/1982 | European Pat. Off. . |
| 0118140 | 9/1984 | European Pat. Off. . |
| 0147505 | 7/1985 | European Pat. Off. . |
| 0174471 | 2/1986 | European Pat. Off. . |
| 0333700 | 9/1989 | European Pat. Off. . |

OTHER PUBLICATIONS

International Search Report for International Application No. PCT/GB92/01374.

Search Repot for British Patent Application No. 9116114.1

"External Pipeline Rehabilitation", R. John, *Pipeline Magazine*, Oct. 1990.

*Primary Examiner*—T. Tung

*Attorney, Agent, or Firm*—Marguerite E. Gerstner; Herbert G. Burkard

[57] ABSTRACT

An impressed current corrosion protection system comprises a distributed anode in the form of a conductive core (4) covered with a conductive polymeric coating (6) and surrounded by packed coke (8) contained within a polymeric jacket (18). This outer jacket is typically a fabric having a specified resistance to acid conditions and chlorine conditions.

12 Claims, 1 Drawing Sheet

CORROSION PROTECTION SYSTEM

BACKGROUND OF THE INVENTION

1. Field of the Invention

This invention relates to an impressed current corrosion protection system, for example for the corrosion protection of buried pipelines or tanks or other substrates.

2. Introduction to the Invention

It is well known to protect an electrically conductive substrate from corrosion by establishing a potential difference between the substrate and a spaced-apart electrode. The substrate and the electrode are connected to each other through a power supply of constant sign (DC or rectified AC) and the circuit is completed when electrolyte is present in the space between the substrate and the electrode. In most such impressed current systems, the substrate is the cathode (i.e. receives electrons). However, with substrates which can be passivated, e.g. Ni, Fe, Cr and Ti and their alloys, it is sometimes also possible to use impressed current systems in which the substrate is the anode. In both cathodic and anodic systems, the substrate is often provided with a protective insulating coating; in this case the impressed current flows only through accidentally exposed portions of the substrate. If the system is to have an adequate life, the electrode must not itself be corroded at a rate which necessitates its replacement; this is in contrast to the "sacrificial anodes" which are used in galvanic protection systems. The electrode must also have a surface which is not rendered ineffective by the current passing through it or by the electrochemical reactions taking place at its surface, such as the evolution of chlorine gas.

The electrode and the power supply must be such that the current density at all points on the substrate is high enough to prevent corrosion but not so high as to cause problems such as damage to the substrate (e.g. embrittlement) or disbonding of a protective coating on it. The power consumption of the system depends inter alia on the distance between the various pans of the substrate and electrode. In view of these factors, the theoretically best type of electrode is one which can be positioned so that it is relatively close to all points on the substrate. To this end it may have a shape corresponding generally to the shape of the substrate. Such an electrode is referred to herein as a "distributed electrode".

EP 0067679 describes a distributed electrode, usually a distributed anode comprising a metal, e.g. copper conductive core and a conductive polymeric jacket. EP 0067679 describes a distributed electrode whose electrically active outer surface is provided by an element which is composed of a conductive polymer which is at least 500 μm, preferably at least 1000 μm, thick. The term "conductive polymer" is used herein to denote a composition which comprises a polymer component, and dispersed in a polymer component, a particulate conductive filler which has good resistance to corrosion, especially carbon black or graphite. In particular the electrode comprises a low resistance core electrically surrounded by a conductive polymer composition, wherein the anode is an electrode spaced apart from the substrate, the electrode being in the form of an elongate flexible strip which can be bent through an angle of 90° over a 10 cm radius, the electrode comprising (1) a continuous, elongate core which is composed of a material having a resistivity at 23° C. of less than $5\times10^{-4}$ ohm.cm and a resistance at 23° C. of less than 0.03 ohm/meter; and (2) an element which (i) is composed of a conductive polymer composition which has an elongation of at least 10%, according to ASTM D1708, (ii) provides at least a part of the electrochemically active outer surface of the electrode, and (iii) is in the form of a coating which electrically surrounds the core and is in electrical contact with the core, and which is at least 500 μm thick.

The entire disclosure of EP 0067679 is incorporated herein by reference.

Where a conductive polymer based anode as described in EP 0067679 is used alone for cathodic protection, after many years, in extreme environments, some of the carbon of the conductive polymer jacket may be consumed as part of the corrosion protection electrochemical process. Therefore it is also known, for corrosion protection of soil-buried substrates, to use a coke breeze back-fill around the anode. Thus, for example, for protection of a buried pipeline, a trench may be dug in the soil near to the pipeline, and as the elongate conductive polymer based anode is payed off into the trench, it is surrounded by a layer (e.g. about 50 mm thick) of coke breeze, before the top soil is replaced. This process is described for example in "External Pipeline Rehabilitation" by R. John, Pipeline Magazine, October 1990. The coke breeze provides a greater overall anode surface, and also decreases the overall resistance of the system.

It is also known to deliver the coke breeze pre-packaged in a nylon fabric jacket, the jacket serving as a delivery tool for the coke.

SUMMARY OF THE INVENTION

We have now discovered that enhanced performance and lifetime can be achieved for a conductive polymeric based impressed current distributed anode by not only installing and delivering the anode in a coke or other carbon rich environment, but by particular selection of the jacketing material containing the carbon rich material such that the carbon rich material remains in the close vicinity of the anode during use of the anode.

The present invention provides a corrosion protection system comprising an elongate element comprising (1) a continuous elongate core which is composed of a material having a resistivity at 23° C. of less than $5\times10^{-4}$ ohm.cm and a resistance at 23° C. of less than 0.03 ohm/meter, (2) a conductive polymer composition which electrically surrounds the core and is in electrical contact with the core, and (3) a polymeric jacket surrounding the conductive polymer composition and containing, between it and the conductive polymer composition, a carbon rich material, preferably coke, characterized in that the material of the polymeric jacket is (i) resistant to acid to the extent that if a section of the jacket material is immersed in hydrochloric acid of at least 0.01N concentration at 60° C. for 90 days and then subjected to a tensile test, and a load versus elongation curve is plotted from the tensile test, then (a) the maximum load recorded during that test is at least 60%, preferably 70% more preferably 80% of the maximum load recorded for a load versus elongation curve for a similar section of the same material which has not been subjected to immersion in the said hydrochloric acid, and (b) the elongation of the said section at the maximum load is at least 60%, preferably 70%, more preferably 80% of the elongation at the maximum load of a similar section which has not been subjected to immersion in the said hydrochloric acid; and (ii) resistant to chlorine to the extent that if a section of the jacket material is immersed in acidified sodium hypochlorite for 90 days, during which time sufficient acid is added to the hypochlorite solution periodically such that chlorine is continually present (i.e. chemical chlorine), and then the said section subjected to a tensile test, and a load versus elongation curve is plotted from the tensile test, then (a) the maxima load recorded during that test is at least 70%, preferably 80%, more preferably 90% of the maximum load recorded for a load versus elongation curve for a similar section of the same material which has not been subjected to immersion in acidified sodium hypochlorite solution, and (b) the elongation of the said section at the maximum load is at least 60%, preferably 70%, more preferably 80% of the elongation at the maximum load of a similar section which has not been subjected to immersion in the acidified sodium hypochlorite solution.

DETAILED DESCRIPTION OF THE INVENTION

For the avoidance of doubt we make it clear that the term conductive polymer, being a composition comprising a polymer component and dispersed therein a particulate conductive filler, includes those compositions in which the polymer component is a thermoplastic, a rubber or a thermoplastic rubber, e.g. butyl or nitrile rubber, olefin homopolymers and copolymers and other materials for example as set out on Page, 4 lines 20–25 of EP-B-0067679.

The acid resistance is measured by immersion in hydrochloric acid of at least 0.01N concentration. A 0.01N hydrochloric acid solution represents a pH of about 2. This acidity corresponds to the acidity value that may be generated in the environment (e.g. soil) when the corrosion protection system is used. The acid resistance is defined by tests at 60° C. The 60° C., 90 day resistance test is an accelerated acid resistance measurement, and represents long lifetime acid resistance at normal usage temperature.

Preferably the behavior at lower temperatures, e.g. room temperatures or 45° C., is at least as good, if not better than the behavior at 60° C.

Preferably the material of the polymeric jacket is resistant to acid to the extent that if the jacket is immersed in hydrochloric acid of at least 5N concentration at 60° C. for 90 days and then subjected to a tensile test, and a load versus elongation curve is plotted from the tensile tests, then (a) the maximum load recorded during that test is at least 60%, preferably 70%, more preferably 80% of the maximum load recorded for a load versus elongation curve for a similar section of the same material which has not been subjected to immersion in the said hydrochloric acid, and (b) the elongation of the said section at the maximum load is at least 60%, preferably 70%, more preferably 80% of the elongation at the maximum load of a similar section which has not been subjected to immersion in the said hydrochloric acid.

5N hydrochloric acid represents a pH of almost zero. Such acid conditions may be generated in some soil (or other) environments when the corrosion protection system of the present invention is used.

Whatever acid resistance the jacket material exhibits, it must also exhibit the said chlorine resistance defined above.

The material of the polymeric jacket is preferably resistant to acids other than the hydrochloric acid described above. Indeed, we have found that most of the preferred materials useful for the polymeric jacket, which are described in detail later in the specification, are also resistant to phosphoric acid of at least 1N concentration, nitric acid of at least 1N concentration, and sulphuric acid of at least 10% concentration, e.g. when immersed in the acid at room temperature, 60%, preferably 70%, more preferably 80% of the peak load, and elongation at peak load values of a non-immersed sample are retained.

The polymeric jacket may comprise a fabric, or a continuum material, for example a film or sheet. The material must of course be ion permeable to allow passage of ions in the electrochemical process which provides the corrosion protection.

Where the polymeric jacket comprises a fabric then the said section of the fabric which is tested may be individual yarns or fibers of the fabric, or a section of the fabric as a whole. Where the polymeric jacket is a continuum, for example a sheet or film, then a section, say a dumbbell, may be tested. For a fabric, preferably most, more preferably substantially all component fibers of the fabric have the stated minimum chlorine and acid resistance. For a continuum of material such as a sheet or film, then sections of the material, e.g. dumbbell shaped sections, taken in any perpendicular direction and subjected to tensile testing preferably have the stated minimum chlorine and acid resistance. For a fabric, where individual yarns are tested the tensile testing is preferably carried out according to BS test number 1932 part 1: 1989. Where a woven fabric as a whole is tested, testing is preferably carried out according to BS 2576: 1986. Where dumbbells of a sheet are subjected to tensile testing this is preferably carried out according to BS test number BS 2782; Part 3; 1976.

Where the jacket is a fabric, the individual yarns or fibers making up the fabric preferably retain at least 70%, more preferably at least 80%, especially preferably at least 90% of their tenacity (in N/Tex) after immersion for 90 days in acidified sodium hypochlorite (in which chlorine is continually present, as described above).

By way of description but not in any way to limit choice of materials to be used in this invention preferred materials are polymers, copolymers or blends of polyacrylonitrile, partially or wholly halogenated aliphatic polymers, particularly polyvinylidene chloride or fluoride polytetrafluoroethylene, poly (ethylene-tetrafluoroethylene), poly (ethylene-chlorotrifluoroethylene), polyvinyl fluoride, polyvinylchloride and polyvinylacetate. Preferred materials based on polyacrylonitriles are Dralon (Bayer), Orlon (Du Pont), Courtelle (Courtaulds), Acrilan (Monsanto), and Dolan (Hoechst). Especially preferred materials are modacrylic polymers, that is a material comprising between 35% and 85% polyacrylonitrile, for example, Teklan (Courtaulds—which comprises 50/50 polyacrylonitrile/polyvinylidene dichloride), Velicren (Enimont), SEF (Monsanto) and Kaneklon (a vinyl chloride based composition supplied by Kanegafuchi). Another preferred material is Saran (PVDC copolymer from Dow Chemical). Another possible, though less preferred, material is poly(butylene-terephthalate). This has good chlorine resistance, and the desired acid resistance in environments of about pH2 (or in less acid environments). However its acid resistance in pH environments approaching 0 is less favorable than the materials referred to above.

The fabric may comprise mono-filaments or multi-filaments. Multi-filaments are preferred for flexibility. The fabric may, also comprise staple yarns or tapes manufactured from any of the above materials. Hybrid fabrics or yarns may also be used. As examples of hybrid yarns there may be mentioned core/sheath yarns involving a core of one type of yarn and a sheath of another type of yarn (e.g. made according to the known so called DREF process), wrap spun yarns in which fibers of one type are surrounded by a fleece of another type of fibrous material and the two wrapped in fine filaments of another or one of the same fibrous materials, commingled staple fibers of different types, and commingled multi-filament yarns, wrapping by hollow spindle spinning, double yarn wrapping, and multi ply twisted yarns. Other possibilities for hybrid fibers and yarns would be apparent to the man skilled in the art. Hybrid fabrics can be made by weaving or otherwise intermixing yarns of different types of fibers.

As another example, polymer coated yarns may be used. For example polymer extruded onto a core of e.g. glass or nylon may be used. Where coated yarns are used, either the coating, or the core or both are made from materials exhibiting the stated acid and chlorine resistance defined by the claims. The yarns may be individually coated, or the fabric coated as a whole, on some or all sides.

Where hybrid yarns are used, preferably at least one, and preferably all materials making up the hybrid yarn have the stated acid and chlorine resistance. The different components of a hybrid yarn can be selected to give the desired combination of properties. For example, one component may be selected for abrasion resistance or tensile strength, and another component selected for acid and chlorine resistance, or one component may be selected to adjust flexibility of the fabric. For example, a polyurethane or PVC coating may be applied to adjust fabric flexibility.

Preferably the elongate element of the invention is flexible to the extent that it can be bent through an angle of 90° over a 40, preferably a 30, more preferably a 20, especially preferably a 15 cm radius, in the temperature range 0° C. to 40° C. Preferably the jacketing material has sufficient strength to accommodate such flexing.

The continuous elongate core and conductive polymer composition surrounding the core may be even more flexible than the overall elongate element of the invention. It may, for example, bend around a 10 cm radius in the stated temperature range.

In addition to acid and chlorine resistance, other preferred features of the invention include fabric strength, mold resistance, alkaline resistance, UV resistance, hydrocarbon resistance, tear and abrasion resistance, burst resistance, wettability, printability and ion permeability.

Resistance to alkaline conditions may be measured, for example, by immersion of a section of the jacket material (as hereinbefore described) in 20% sodium carbonate solution (pH about 11) for 90 days. Preferred materials retain at least 70%, preferably at least 80%, 90% or even 95% of their tenacity (in N/Tex) throughout the 90 day period. The materials also preferably retain at least 80%, preferably at least 90% or even 95% of their elongation at peak load (as measured in the manner specified earlier) during the 90 day immersion in the alkaline solution.

UV resistance may be measured by exposing a section of the jacket material cyclically to UV for 8 hours at 60° C. and then to 4 hours condensation at 50° C. for a total of 1000 hours (so-called QUV testing according to ASTM G53 (1984)). Preferably the jacket material retains at least 20%, preferably at least 30%, more preferably at least 40% of its tear resistance during the exposure cycle.

Hydrocarbon resistance may be measured by immersing a section of jacket material in ASTM No. 1 oil for 90 days at room temperature. Preferred jacket materials according to the invention retain at least 80%, preferably at least 90% of their elongation at peak load during the immersion period.

As well as tensile testing after immersion in acidified hypochlorite solution, resistance to chlorine can also be measured by considering the resistance to electrochemically produced chlorine. To measure the resistance to electrochemically produced chlorine the following test can be carried out. A section of the material of the jacket (e.g. a fiber or yarn if the material of the jacket is a fabric) is wrapped around a graphite electrode and made an anode in an electrochemical cell containing 3% sodium chloride solution in water. An electrical constant current of 100 mAmps is passed through the cell for 50 days at a voltage of at least 2 volts. The section of material of the jacket is then subjected to a tensile test, and a load versus elongation curve is plotted as explained for the other tests above. A preferred section of jacket material according to the invention retains at least 60%, preferably at least 70%, more preferably at least 80% of its elongation at the maximum load recorded during the tensile test, compared to a similar section of jacket material that has not been exposed to electrochemical chlorine. Also, a preferred section of jacket material retains at least 70%, preferably at least 80%, more preferably at least 90% of its maximum load compared to a control fiber that has not been subjected to electrochemical chlorine.

The fabric jacket containing the carbon rich material may be made in a circular construction, e.g. by circular weaving, knitting, or braiding, or may be based on a non-woven fiber. Combinations of manufacturing techniques may be used in the same fabric layer, or in superimposed layers. For example a non-woven fleece may be superimposed onto a woven or knitted fabric. In other embodiments the fabric jacket is wraparound and longitudinal edges of the fabric are joined to each other. For a wraparound design the fabric may be, for example, a flat weave. This may be e.g. a plain weave or a 2/2 broken twill weave. Typically it will have 20–80 warp ends/inch and 10–60 weft picks/inch. The edges of a wraparound design may, for example, be abutted and bonded to each other in an upstanding fin arrangement (which may point inwardly or outwardly of the jacket). Alternatively the longitudinal edges may simply be overlapped and bonded to each other. Bonding may involve mechanical means such as stitching (one or more seams may be used), hooks and eyes, e.g. Velcro strip, stapling, riveting, using clips, or clamps, or bonding may involve the use of adhesives, or bonding may be for example by welding, e.g. ultrasonic welding, air welding, hot wedge welding, radio frequency welding, inductive heating, or solvent welding. Where stitching is used, there are typically 3–10 stitches/inch. Stitch types may be, for example double thread chain stitch, lock stitch or, 3-thread overlock. Suitable sewing threads include PTFE and Dralon T (Bayer). Other suitable bonding techniques would be apparent to the man skilled in the art. Combinations of joining techniques may also be used, e.g. adhesive bonding combined with a mechanical means. The joining technique selected depends on the nature of the jacket material selected. Where an adhesive is used, alone or in combination with another bonding technique, examples of suitable adhesives that may be used include polyvinylidene dichloride, and its copolymers (e.g. Saran from Dow Chemical), polyvinyl chloride, and its copolymers, fluoropolymer resins, acrylic resins, and acrylic acid or methacrylic acid copolymers (e.g. Primacor and Nucrel from Dow Chemical and Du Pont respectively).

Preferably the strength of any bond between longitudinal edges of a wraparound jacket is at least as strong as the material of the jacket itself, when tested in tension, and subjected to acid and chlorine resistance testing as described above.

Preferably a joint formed by wrapping a fabric strip in a tube and bonding it along a longitudinal edge and then subjected to hoop forces retains 90%, preferably substantially all its hoop stress when immersed in 5N hydrochloric acid for 90 days at 60° C. or when immersed in acidified sodium hypochlorite in which chlorine is continually present (chemical chlorine) for 90 days. Similarly it preferably retains 90%, preferably substantially all its peel strength when immersed in the acid or chemical chlorine for 90 days.

Preferably the strength of the fabric/adhesive combination, when tested in peel, and after immersion in water for 4 days, is at least 2, preferably at least 3, especially at least 5N/10 mm. This peel strength is preferably exhibited from room temperature up to temperatures of at least 40° C. or preferably 50° C., or even, e.g. in the case of a methacrylic acid copolymer adhesive, up to about 80° C.

Preferably the adhesive bond is also resistant to oil. Preferably it retains at least 80%, preferably 90%, more preferably substantially all its peel strength when immersed in ASTM No. 1 oil for 100 days.

The adhesive bond is also preferably resistant to UV, and when cyclically exposed to UV for 8 hours at 60° C. then condensation at 50° C. for 5 hours for a total of 1000 hours according to ASTM G53 (1984) the bond preferably retains 80%, more preferably 90% of its peel strength.

The material of the jacket must be porous to the extent that is permeable to ions so that the corrosion preventative electrochemical reactions can take place. In one embodiment the jacket material may comprise apertures of a few microns, tens of microns or even up to 0.5 cm or more. The apertures must however be sufficiently small to retain substantially all the carbon rich material within the jacket adjacent the anode. This will depend on the nature of the carbon rich material used.

The carbon rich material surrounding the conductive polymeric material may comprise, for example, lamp black or carbon black particles, coke pieces, preferably coke pieces having a particle diameter of the order of 100 to 500 microns, although other larger sizes could be used, natural graphite, carbon powder or short cut fiber in a fibrous mat, pyrolitic graphite, pyrolized polyacrylonitrile, or vitreous carbon.

BRIEF DESCRIPTION OF THE DRAWINGS

An embodiment of the present invention will now be described, by way of example, with reference to the accompanying drawings, whereas.

DETAILED DESCRIPTION OF THE DRAWINGS

Figure 1:
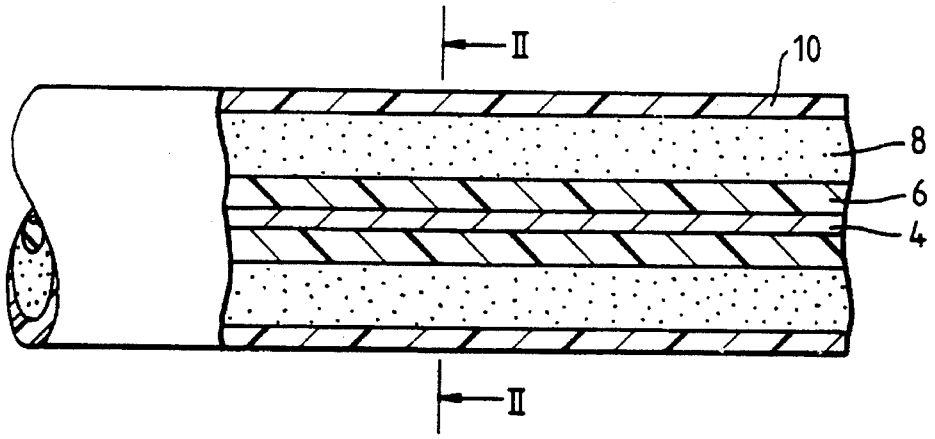
FIG. 1 is a longitudinal sectional view of an elongate element according to the invention.
Figure 2:
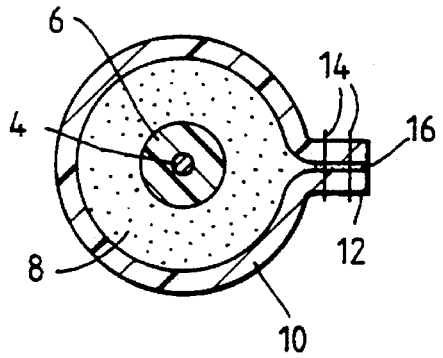
FIG. 2 is a cross-sectional view of the device of FIG. 1.

Referring to the drawings, FIGS. 1 and 2 show a device 2 comprising a copper wire 4 surrounded by a conductive polymeric jacket 6. Surrounding jacket 6 is coke breeze 8 with a containing jacket 10 comprising a weave of a polyacrylonitrile based material.

Jacket 10 is wraparound and longitudinal edges 12 abut in an upstanding seam, with two rows of stitches 14 extending along the seam, and an adhesive bond 16 between the seams.

Figure 3:
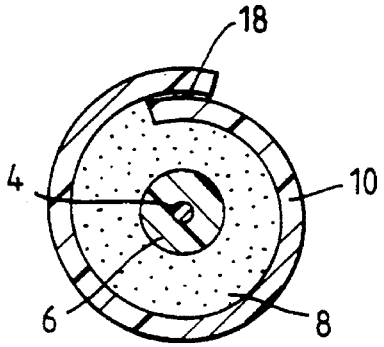
FIG. 3 is a cross-sectional view of another device according to the invention.

FIG. 3 shows an alternative joining arrangement in which the longitudinal fin edges of the sleeve overlap and are bonded by adhesive 18. In this case there is no stitching.

Instead of a wraparound jacket, a tubular jacket material may be used (not illustrated).

EXAMPLES

As examples, the fabric used for the woven jacket 10 was made in the following two ways:

Example 1

The fabric jacket 10 was woven from Velicren™ staple fiber yarns. The warp and weft yarns were two fold with a resultant linear density of 60 Tex. Tex is the I.S.O. designated method for measuring linear density and it is the weight in grams of 1000 meters of yarn. The yarns were woven into a plain weave fabric (1 up/1 down) with a warp insertion of 66 ends per inch and weft insertion of 32 picks per inch. The fabric weight per square meter was 245 grams and thickness of the fabric was 0.38 mm.

Example 2

The fabric jacket 10 was woven from Dralon™ "T", continuous multi-filament yarns. The warp and weft yarns were singles untwisted with a linear density of 44 Tex. The yarns were woven into a plain weave fabric with a warp insertion of 44 ends per inch and weft insertion of 50 picks per inch. The fabric weight was 160 grams per square meter and the thickness of the fabric was 0.33 mm.

We claim:

1. A corrosion protection system comprising a flexible elongate element comprising (1) a continuous elongate core which is composed of a material having a resistivity at 23° C. of less than $5\times10^{-4}$ ohm.cm and a resistance at 23° C. of less than 0.03 ohm/meter, (2) a conductive polymer composition which electrically surrounds the core and is in electrical contact with the core, and (3) a polymeric jacket surrounding the conductive polymer composition, and containing between it and the conductive polymer composition a carbon rich material, characterized in that the material of the polymeric jacket (i) is permeable to ions;

(ii) comprises a fabric which comprises a pure or modified polyacrylonitrile, a modacrylic, polyvinylidene dichloride, polyvinylidene difluoride, poly(ethylenetetrafluoroethylene), poly (ethylene-chlorotrifluoroethylene), polyvinyl fluoride, polyvinyl chloride, poly(butylene terephthalate), polyvinylacetate, or copolymers or blends thereof;

(iii) is a wraparound and comprises two longitudinal edges which abut or overlap and are held together at least partly by an adhesive;

(iv) is resistant to acid to the extent that if a section of the jacket material is immersed in hydrochloric acid of at least 0.01N concentration at 60° C. for 90 days and then subjected to a tensile test according to British Standard test number 1932 part 1:1989 for individual yarns of the fabric or British standard test number 2576:1986 for the fabric as a whole, and a load versus elongation curve is plotted from the tensile test, then (a) the maximum load recorded during that test is at least 60% of the maximum load recorded for a load versus elongation curve for a similar section of the same material which has not been subjected to immersion in the said hydrochloric acid, and (b) the elongation of the said section at the maximum load is at least 60% of the elongation at the maximum load of a similar section which has not been subjected to immersion in the said hydrochloric acid; and (v) is resistant to chlorine to the extent that if a section of the jacket material is immersed in acidified sodium hypochlorite for 90 days, during which time sufficient acid is added to the hypochlorite solution periodically such that chlorine is continually present, and then the said section subjected to a tensile test, and a load versus elongation curve plotted from the tensile test, then (a) the maximum load recorded during that test is at least 70% of the maximum load recorded for a load versus elongation curve for a similar section of the same material which has not been subjected to immersion in acidified sodium hypochlorite solution, and (b) the elongation of the said section at the maximum load is at least 60% of the elongation at the maximum load of a similar section which has not been subjected to immersion in the acidified sodium hypochlorite solution.

2. A corrosion protection system according to claim 1, wherein the longitudinal edges of the wraparound overlap each other in a substantially flat profile.

3. A corrosion protection system according to claim 1, wherein the adhesive comprises a copolymer of polyvinylidene dichloride, an acrylic acid copolymer, or a methacrylic acid copolymer.

4. A corrosion protection system according to claim 1 wherein the longitudinal edges of the wraparound abut each other in an upstanding flange.

5. A corrosion protection system according to claim 1 wherein the maximum load recorded during the test of immersion in hydrochloric acid is at least 70%.

6. A corrosion protection system according to claim 5 wherein the maximum load recorded during the test of immersion in hydrochloric acid is at least 80%.

7. A corrosion protection system according to claim 1 wherein the elongation of the said section at the maximum load during the test of immersion in hydrochloric acid is at least 70%.

8. A corrosion protection system according to claim 7 wherein the elongation of the said section at the maximum load during the test of immersion in hydrochloric acid is at least 80%.

9. A corrosion protection system according to claim 1 wherein the maximum load recorded during the test of immersion in acidified sodium hypochlorite is at least 80%.

10. A corrosion protection system according to claim 9 wherein the maximum load recorded during the test of immersion in acidified sodium hypochlorite is at least 90%.

11. A corrosion protection system according to claim 1 wherein the elongation of the said section at the maximum load during the test of immersion in hydrochloric acid is at least 70%.

12. A corrosion protection system according to claim 11 wherein the elongation of the said section at the maximum load during the test of immersion in acidified sodium hypochlorite is at least 80%.

* * * * *

UNITED STATES PATENT AND TRADEMARK OFFICE

CERTIFICATE OF CORRECTION

PATENT NO. : 5,512,153
DATED : Apr. 30, 1996
INVENTOR(S) : Day, et al

It is certified that error appears in the above-indentified patent and that said Letters Patent is hereby corrected as shown below:

Column 1, line 39, replace "pans" by --parts--.

Column 1, line 46, replace "copper" by --copper,--.

Column 2, line 63, replace "70%" by --70%,--.

Column 3, line 11, after "section" insert --is--.

Signed and Sealed this

Seventeenth Day of September, 1996

*Attest:*

Bruce Lehman

BRUCE LEHMAN

*Attesting Officer*

*Commissioner of Patents and Trademarks*